US006115539A

United States Patent [19]

Cohn

[11] Patent Number: 6,115,539

[45] Date of Patent: Sep. 5, 2000

[54] MODULE FOR PRODUCING HOT HUMID AIR FOR A PROOFING OR HOLDING CHAMBER

[76] Inventor: Robert J. Cohn, 61 Sterling Ave., Dallas, Pa. 18612

[21] Appl. No.: 09/228,118

[22] Filed: Jan. 11, 1999

Related U.S. Application Data

[63] Continuation-in-part of application No. 09/192,345, Nov. 16, 1998.

[51] Int. Cl.[7] ..... F24F 3/14; A61H 33/12

[52] U.S. Cl. ..... 392/402; 392/405

[58] Field of Search ..... 392/386, 387, 392/394, 400, 401, 402, 403, 404, 405, 406; 122/4 A, 13.2, DIG. 10; 219/523

[56] References Cited

U.S. PATENT DOCUMENTS

| | | | |
|---|---|---|---|
| 1,182,688 | 5/1916 | Kirby | 392/405 |
| 3,660,635 | 5/1972 | Liebert | 392/387 |
| 3,723,707 | 3/1973 | Wunderlin | 392/405 |
| 3,982,095 | 9/1976 | Robinson | 392/403 |
| 4,284,878 | 8/1981 | Bartels | 392/403 |
| 4,339,307 | 7/1982 | Ellis, Jr. | 219/523 |
| 5,616,115 | 4/1997 | Gloyd et al. | 392/403 |
| 5,930,459 | 7/1999 | Eckman et al. | 219/523 |

*Primary Examiner*—Sang Paik
*Attorney, Agent, or Firm*—Michael Ebert

[57] ABSTRACT

A module adapted to generate a controllable volume of steam for humidifying an air stream. The module includes a generally rectangular tank transversely divided by a barrier wall into a water reservoir section and a steam generating section. The longitudinal position of the barrier wall in the tank is adjustable to vary the relative water capacities of the sections. Disposed within the steam generating section is a controllable electric heater unit that acts to boil the water in this section at an adjustable rate to generate steam which is discharged into the air stream. The water boiled off in the steam generating section is replenished by water drained from the reservoir section through a flow passage in the barrier wall.

18 Claims, 6 Drawing Sheets

MODULE FOR PRODUCING HOT HUMID AIR FOR A PROOFING OR HOLDING CHAMBER

RELATED APPLICATION

This application is a continuation-in-part of my copending application entitled "MODULE FOR PRODUCING HOT HUMID AIR FOR A PROOFING OR HOLDING CHAMBER" Ser. No. 09/192,345 filed Nov. 16, 1998. The entire disclosure of this copending application is incorporated herein by reference.

BACKGROUND OF INVENTION

1. Field of Invention

This invention relates generally to steam generators for humidifying an air stream, and more particularly to a module for this purpose formed by a tank divided by a barrier wall into a water reservoir section and a steam generating section, water boiled off in the steam generating section being replenished by water drained from the reservoir section.

2. Status of Prior Art

As pointed out in our above-identified copending patent application, a proofing chamber requires a hot and humid atmosphere in order to raise dough pieces placed within this chamber preparatory to their being baked. A similar atmosphere is necessary in a holding chamber to maintain cooked food placed therein in a hot and moist state in condition for serving. To satisfy the atmospheric requirements for a proofing chamber and the different requirements for a holding chamber, it is essential that the steam source of this atmosphere be adjustable to produce an atmosphere whose relative humidity is appropriate to the chamber.

The absolute humidity of air is the weight of water in a unit volume of air. Relative humidity is the ratio, in percentage terms, of the moisture actually in the air (absolute humidity) to the moisture the air would hold if it were saturated at the same air temperature and pressure. The point at which saturation is reached represents the capacity of the air to hold water vapor. This point increases rapidly as the air temperature increases.

In a module of the type disclosed in my prior U.S. Pat. No. 5,802,963 entitled "Module for Producing Hot Humid Air," water from a reservoir is fed into a steam generator having an electric heater. Steam from this generator is injected into a duct in which a blower draws in air through a duct inlet and blows it through an air heater to produce a humid, hot air stream which is exhausted from the duct outlet. The relative humidity of the resultant stream depends on the amount of steam injected therein and the temperature of the air.

With this module it becomes possible to adjust the temperature of the air stream as well as its relative humidity. But we have found that it is not possible, when operating in conjunction with a holding chamber, to provide an atmosphere for this chamber appropriate for certain food holding conditions, such as an atmosphere whose air temperature is well above 130° F. and whose relative humidity exceeds 50 percent.

More water vapor is required to produce a high relative humidity at higher temperatures. Thus if the air temperature is 130° F. and a certain amount of steam is injected into the heated air to impart a high relative humidity thereto, given the same amount of steam, but an air temperature of 150° F., the relative humidity will then be substantially lower.

The difficulty with the module disclosed in my prior patent is that it is unable to supply to the hot air stream whose air is at an elevated temperature the greater volume of steam needed to produce a high relative humidity. Hence the module, though capable of providing an atmosphere that is appropriate for the wide range of conditions encountered in proofing, it is unable to provide an atmosphere appropriate for a wide range of holding conditions.

In a module of the type disclosed in my above-identified copending application, the module is adapted to operate effectively in conjunction either with a proofing chamber in which dough pieces are raised prior to baking by being subjected to a stream of hot and humid air, or in conjunction with a holding chamber in which cooked food is maintained in a hot, moist state in condition for serving.

This module is provided with a water reservoir from which water is fed into a steam generator where the water is boiled to generate steam. Associated with the module is an air duct having an inlet which feeds incoming air through a blower and an air heater toward an outlet whereby air drawn into the duct through its inlet by the blower is heated to produce a stream of hot air that is exhausted from its outlet. A steam tube coupled to the steam generator injects steam into a positive-pressure zone in the duct beyond the blower therein to intermingle with the stream of hot air to produce a stream of hot and humid air. When the module operates in conjunction with a proofing chamber this stream is fed therein to effect a proofing action.

Steam from the steam chamber is also fed into a negative-pressure zone in the duct in advance of the blower therein to produce a stream of hot and humid air having a higher temperature whereby when the module operates in conjunction with a holding chamber, it then effects a holding action for the cooked food therein.

In my copending application, the module disclosed therein in which a covered water tank is divided by a barrier wall into a reservoir section and a steam generating section, is directly associated with an air duct provided with a blower and an electric heater to produce a hot air steam into which is injected steam discharged from the module.

The need exists for a stand alone, steam-generating module that need not be associated with an air duct provided with a blower and a heater, for when the module is so associated the operation of the module is limited to the air capacity of the duct. There are many practical applications for a steam generator other than for producing a hot and humid atmosphere for a proofing or holding chamber in which the basic requirement is humidification regardless of whether the air stream in which the steam is injected is at a low or high temperature. Indeed, in some applications the air stream may be air conditioned.

When a steam generator of the type disclosed in the above-identified copending patent application makes use of a conventional electric water heater unit having a metallic heater element in direct contact with water, then in the course of prolonged operation, lime and other minerals dissolved in the water are coated on and adhere to the metallic surfaces. This lime coating is thermally insulating and reduces the effectiveness of the unit. Hence when a standard electric water heater unit is mounted within the steam generating section of the module, it becomes necessary on occasion to shut down the steam generator in order to delime it.

Of prior art interest in regard to electric water heater units is the Eckman U.S. Pat. No. 5,586,214. This patent discloses an immersion heater whose electric resistance elements are encapsulated within a layer of polymeric material that is electrically insulating but thermally conductive and therefore does not thermally insulate the heating element from the water in contact with the polymeric layer.

SUMMARY OF INVENTION

In view of the foregoing, the main object of this invention is to provide a module adapted to generate a controllable volume of steam for humidifying an air stream.

More particularly, an object of this invention is to provide a module of the above type formed from a water tank divided by a barrier wall into a water reservoir section and a steam generating section, water boiled off in the steam generating section being replenished by water drained from the reservoir section.

A significant advantage of a module in accordance with the invention is that when steam discharged from the module is injected into a heated air stream to humidify the stream, the module is then adjustable to vary the relative humidity of the stream.

Yet another object of the invention is to provide a module of the above type in which an immersion heater unit disposed in the steam generating section of the module has a polymeric outer layer in contact with the water.

An advantage of a steam generator that includes this unit is that it does not require deliming.

Briefly stated, these objects are attained by a module adapted to generate a controllable volume of steam for humidifying an air stream. The module includes a generally rectangular tank transversely divided by a barrier wall into a water reservoir section and a steam generating section. The longitudinal position of the barrier wall in the tank is adjustable to vary the relative water capacities of the sections. Disposed within the steam generating section is a controllable electric heater unit that acts to boil the water in this section at an adjustable rate to generate steam which is discharged into the air stream. The water boiled off in the steam generating section is replenished by water drained from the reservoir section through a flow passage in the barrier wall.

BRIEF DESCRIPTION OF DRAWING

For a better understanding of the invention, as well as further features thereof, reference is made to the detailed description thereof to be read in connection with the annexed drawings wherein.

DESCRIPTION OF INVENTION

Figure 1:
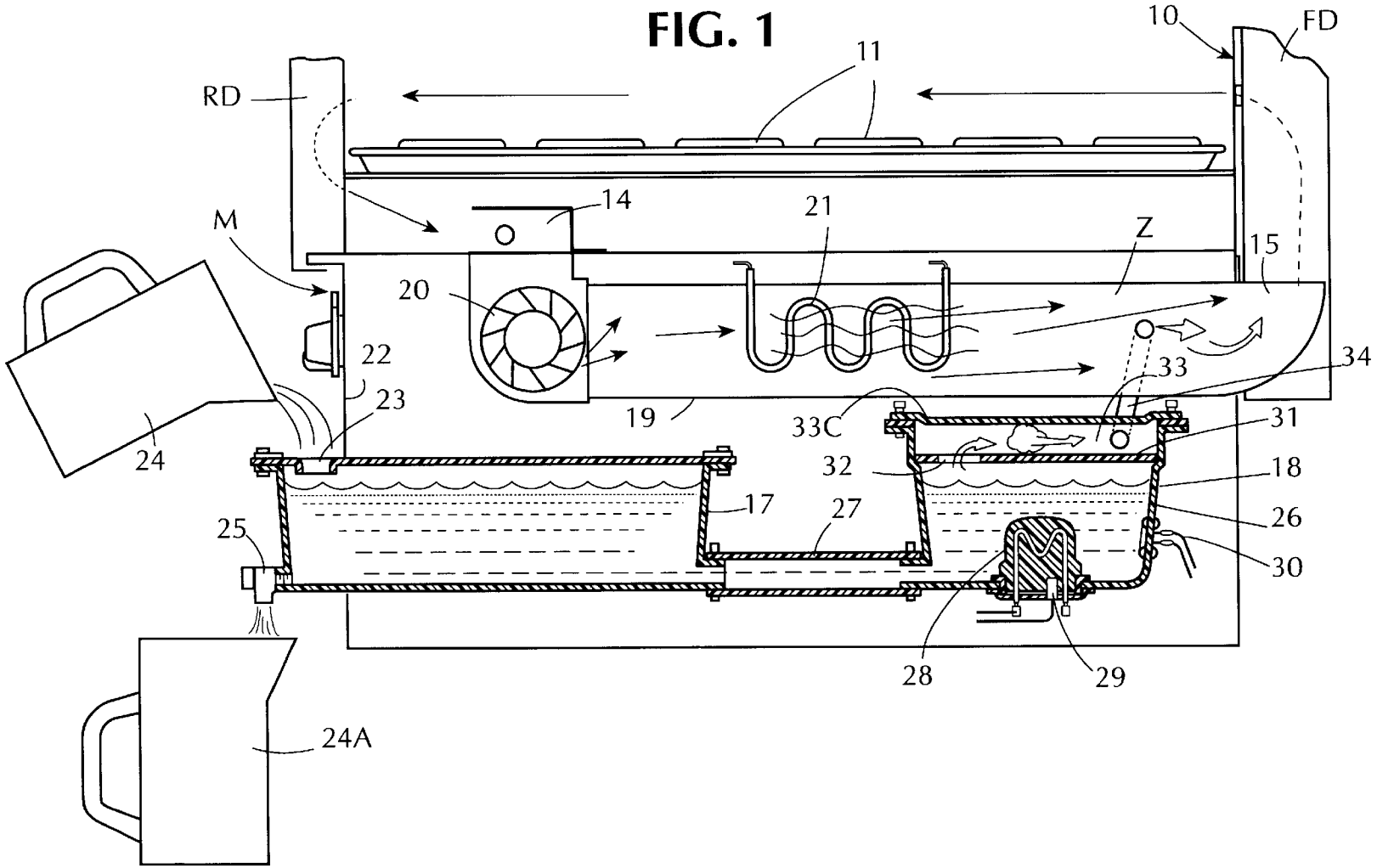
FIG. 1 schematically illustrates a first embodiment of a module in accordance with the invention operating in conjunction with a proofing chamber in which pieces of yeast dough are subjected to an atmosphere of hot, humid air discharged from the module.

The Module and Proofing Chamber Assembly:

Referring now to FIG. 1 there is shown an assembly for converting a multi-level baker's rack 10 into a chamber for proofing shaped yeast dough pieces contained in pans 11 loading the rack. The assembly is composed of a soft hood the type disclosed in U.S. Pat. No. 5,802,963 formed of synthetic plastic sheet material associated with a module M in accordance with the invention for generating hot, humid air to be recirculated throughout the proofing chamber defined by the hood. In practice, rack 10 may be a standard baker's rack or a standard rack modified to better accept the soft hood.

Received in the base section of rack 10 is a module M in accordance with the invention which generates the hot, humid air that is recirculated throughout the proofing chamber. Module M includes an air intake 14 which is coupled to a return duct RD in the proofing chamber created by the space between rack 10 and the front end wall of the hood. Also included in module M is an exhaust vent 15 from which hot, humid air is discharged into a feed duct FD created by the space between the rear end of the hood and rack 10.

All levels of baker's rack 10 are occupied by pans 11 carrying shaped pieces of yeast dough to be proofed, and below the stack of pans at the base of the rack is module M which emits from its exhaust vent 15 a stream of hot, humid air which is blown into feed duct FD.

Within an air duct 19 in module M which fits into the base of rack 10 is a blower 20 which blows air drawn from air intake 14 through an electric heater element 21. The resultant hot air passes through a mixing zone Z before being discharged from exhaust vent 15. Injected into this mixing zone is steam produced by a steam generator, hence the hot air is rendered humid.

Blower 20 within the module therefore creates a negative pressure at its intake 14 which communicates with return duct RD, and a positive pressure at exhaust vent 15 which communicates with feed duct FD of the proofing chamber.

As shown by the arrows in FIG. 1 a stream of hot, humid air discharged under positive pressure into feed duct FD from the exhaust vent 15 of the module passes from the feed duct across the dough pieces in pans 11 at every level of rack 10 toward return duct RD. The volume of hot, humid air is substantively the same at every level of the rack. The flow into return duct RD which is under negative pressure causes the stream of hot, humid air, after having subjected the dough pieces to a proofing environment, to be sucked back into the module through air intake 14 to produce a stream that is continuously recirculated in the proofing chamber.

Thus module M in combination with multilevel rack 10 and soft hood 12 covering the rack acts to develop within the proofing chamber a circulating flow loop in which hot, humid air continuously flows concurrently through all levels of the rack to uniformly proof the dough pieces supported on each of these levels. Hence all pieces are proofed to the same degree, no piece being overproofed or underproofed.

The Module (First Embodiment):

In a first embodiment of a module in accordance with the invention as illustrated schematically in FIG. 1, it will be seen that one section of the casing which houses the module is occupied by a water reservoir 17 and the adjacent steam generator 18. occupying a parallel section of the casing is the air duct 19 within which is the motor driven blower 20 and the electric air heater element 21. The air intake 14 at one end of duct 19 leads air into blower 20 and the blown air which passes through heater element 21 and a mixing zone Z is exhausted from the duct through exhaust vent 15.

Figure 2:
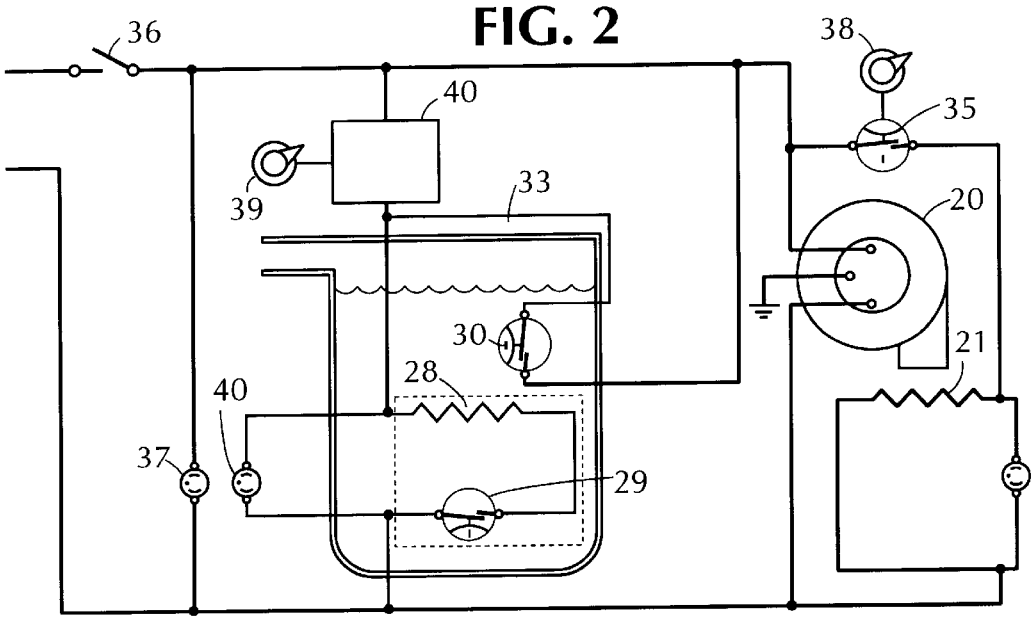
FIG. 2 is a schematic diagram of the electrical control circuit of the module.

Water reservoir 17 is in the form of a rectangular tray molded of transparent synthetic plastic material, such as an acrylic plastic. The front end of the reservoir projects out of an opening in the front panel 22 of the module. The reservoir is sealed by a top cover having at its front end an inlet 23 into which can be poured water to replenish the supply. Thus FIG. 2 shows a pitcher 24 feeding water into reservoir 17 through inlet 23. The level of water in reservoir 17 is visible through its transparent front end; hence one can tell when the water level is low and requires replenishment. And there is no need to open the proofing chamber in order to add water to the reservoir.

The projecting front end of reservoir 17 is provided with a drain valve 25 so that by opening this valve one can drain into a pitcher 24A all of the water contained in reservoir 17 and in steam generator 18.

Steam generator 18 includes a water pan 26 coupled by a feed pipe 27 at its base to the base of reservoir 17. Hence the level of water in pan 26 is the same as that in reservoir 17, the level being progressively reduced as water is boiled off. Reservoir 17 has a much larger water capacity than pan 26, and while the water in pan 26 is raised to an elevated temperature, because the pan is coupled to the reservoir by feed pipe 27 having a relatively small diameter, the water in reservoir 17 remains cool and there is little loss of heat from the steam generator.

Anchored at the base of water pan 26 is an electric water heater element 28 provided with a temperature sensor 29. Mounted on a side wall of pan 26 is a pre-heat thermostat 30. In practice, heater element 28 may be a 700 watt electric heater which is capable of quickly bringing the water in the pan to its boiling point.

Pan 26 is covered by a baffle plate 31 having an opening 32 therein which vents steam generated in the pan into a small steam chamber 33 above the pan provided with a top cover 33C. But because the steam in chamber 33 is exhausted into air duct 19, there is no pressure build-up in the chamber.

Air drawn into air intake 14 of duct 19 by blower 20 is blown, as shown by the arrows in FIG. 1, through electric air heater element 21 to produce a hot air stream that flows through mixing zone Z toward exhaust vent 15 at the outlet end of air duct 19. Air heater element 21 is preferably in the form of an undulating resistance element which emits infrared energy over an extended area in the direction of air flow.

Steam from steam chamber 33 in steam generator 18 is fed into mixing zone Z in the air duct by a steam tube 34, which bridges the side walls of duct 19 and is provided with a row of holes, each of which injects steam in the direction of air flow in zone Z where the injected steam intermingles with the hot air stream. Thus the stream of hot, humid air emerging from exhaust vent 15 and fed into feed duct FD of the proofing chamber has a high humidity level. The holes in steam tube 34 are sufficiently large as to cause all of the steam carried by this tube to exit into mixing zone Z. Hence there is no pressure build-up in steam chamber 33 or elsewhere in the module.

Because the hot air stream is rendered humid just after it flows past air heater element 21, the air is then at its highest temperature and is capable therefore of accepting the maximum volume of moisture. Relative humidity is the ratio in percent of the moisture actually in the air to the moisture it would hold if it were saturated at the same temperature and pressure. A module in accordance with the invention is capable of providing a high percentage of relative humidity, the percentage being adjustable to satisfy existing proofing requirements.

Heater element 21 heats up all components within air duct 19, hence no condensation is formed therein.

The Control Circuit:

The temperature of the air intake above blower 20 is sensed by a thermostatic sensor 35. On front panel 22 of the module is a power switch 36 and a neon light 37 to indicate when the switch is turned on to apply, 117 vAC power to the blower 20 as well as to the air heater element 21 and the water heater element 28 of the module.

Power applied to air heater element 21 is adjustable by means of an air-temperature control knob 38 associated with air thermostat sensor 35. Humidity control is effected by a control knob 39 associated with a variable resistor or triac 40 which varies the power applied to water heater element 28 of the steam generator. A neon light 41 indicates when the water heater is turned on.

When the module is first turned on, full power is applied to water heater element 28 to hasten the production of steam. But when the water in pan 26 of the steam generator reaches a temperature of 190° F., then pre-heat thermostat 30 which senses the water temperature is activated and the amount of power then applied to heater element 28 is determined by humidity control knob 39 and triac 40. In practice, the circuit of the module may be such as to switch on air blower 20 only when steam generator 18 begins to produce steam.

Operation:

When air heater element 21 and water heater element 28 of module 19 are both turned on, water contained in pan 26 of the steam generator supplied thereto by reservoir 17 is boiled to produce steam that is collected in steam chamber 33. As water is boiled off on the steam generator it is replenished by water drained from reservoir 17.

Steam from chamber 33 is injected by tube 34 into mixing zone Z in air duct 19 in the direction of air flow whereby the steam ejected from the row of holes intermingles with the hot air stream to produce a hot, humid air stream which is discharged from exhaust vent 15. This hot, humid air stream is suitable for proofing yeast dough or for any other application requiring an atmosphere of hot, humid air whose temperature and relative humidity are controllable to satisfy operating criteria.

The level of water in reservoir 17 is visible so that when the level is low, an operator can then add water to the reservoir without however having to open the door to the proofing chamber to obtain access to the reservoir, for inlet 23 to the reservoir is outside the proofing chamber. Should it have been necessary to open the door to the proofing chamber, ambient air would then intermingle with the hot, humid environment of the chamber interior and disturb this environment.

When it becomes necessary to clean and delime the water system of module M, all of the water in the reservoir and in the pan of the steam generator can be drained from the module simply by opening drain valve 25 which is outside of the proofing chamber and therefore does not require that the proofing chamber be opened to obtain access to the module.

Figure 3:
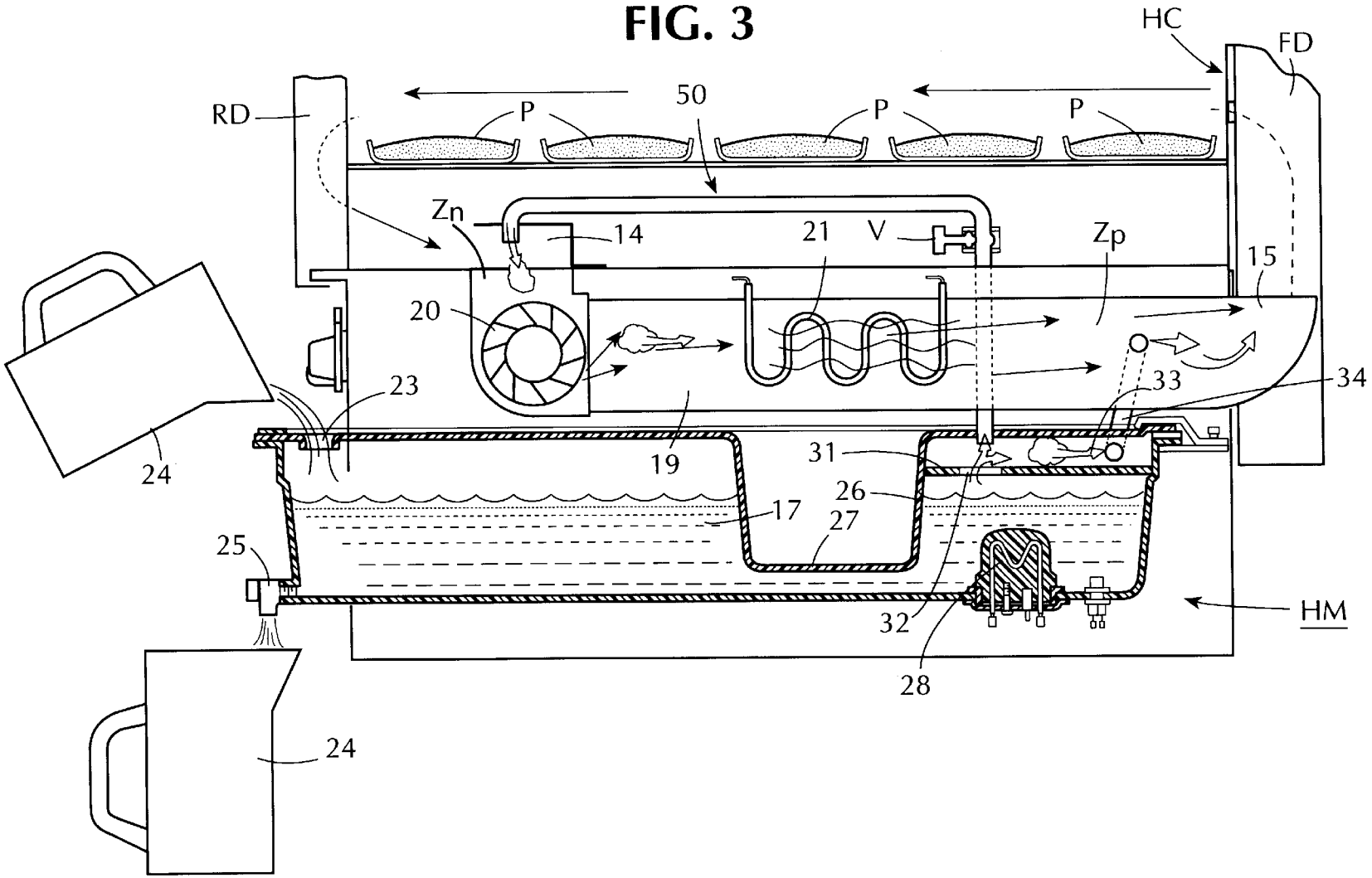
FIG. 3 illustrates a module in accordance with a second embodiment of the invention operating in conjunction with a holding chamber.

Module (Second Embodiment):

Referring now to FIG. 3, module HM shown therein operates in conjunction with a holding chamber HC. Loaded on the shelves or racks of this chamber are hot plates P containing cooked food. The holding chamber acts to maintain for a more or less prolonged period, the food in plates P in a hot and moist state in condition to be served. Thus whether a hot food plate remains in the holding chamber for a half hour or for three hours, in either case, when taken out of the chamber, the food in the plate is in condition to be served as if it had been just cooked. For this purpose, it is not only necessary that the food served be hot, but also that its moisture content be unchanged from the time it was just cooked.

Holding chamber HC is similar in most respects to the proofing chamber shown in FIG. 1, and is provided with a feed duct FC into which is fed a stream of hot, humid air exhausted from outlet 15 of module HM. Chamber HC also includes a return duct RD to return to intake 14 of the module the hot and humid air forming the atmosphere of the holding chamber.

Module HM is the same structurally in all respects as module M in FIG. 1, except for one significant feature to be later described, and it operates in a similar manner. Module HM includes an air duct 19 in which is disposed the motor-driven blower 20 and the electrical air heater element 21.

Air intake 14 to duct 19 is coupled to return duct RD of the holding chamber. Thus the air sucked into duct 19 through intake 14 by blower 20 is blown through heater 21 to produce a hot air stream that is exhausted through outlet 15 of the duct.

The pressure-differential action of blower 20 is such as to produce in inlet 14 of the duct in advance of the blower a negative pressure in a zone Zn which acts to suck air into the duct drawn from return duct RD of holding chamber HC. In the region of duct 19 beyond blower 20 there is created a positive pressure zone Zp. This acts to drive the heated air toward outlet 15 from which it flows into feed duct FD of the holding chamber.

Injected into positive-pressure zone Zp in duct by means of a the steam tube 34 coupled to steam chamber 33 of the steam generator is steam which intermingles with and humidifies the hot air stream. The temperature of the air flowing through the duct is adjusted by varying the power applied to electric air heater 21. The amount of steam that is generated and consequently the relative humidity is adjustable by varying the power applied to water heater 28 in the steam generator.

Since steam ejected from steam tube 34 coupled to steam chamber 33 in the steam generator is under positive pressure and is injected into positive-pressure zone Zp in this duct, this limits the amount of steam that can be entrained in the hot air stream in the positive pressure zone.

When the temperature of the hot air stream is no higher than 130° F. for use in a proofing operations, the amount of steam then injected by tube 34 into the positive-pressure zone Zp is sufficient to obtain the high relative humidity then necessary for a proofing action.

But when in order to obtain a holding action, the temperature of the air stream is turned up to a level in the range of about 140° F. to 180° F., then in order to obtain at this elevated temperature a high relative humidity suitable for holding operation, the amount of steam provided by steam tube 34 may then be inadequate.

In order to provide sufficient steam to operate the module in conjunction with holding chamber HC in which the air stream is heated to a higher temperature level than in a proofing operation, there is provided an auxiliary steam tube 50. Tube 50 extends from the steam chamber 33 of the steam generator 18 to the negative-pressure zone Zn in advance of blower 20 in the duct intake 14.

Because of this negative pressure, steam is drawn through auxiliary tube 50 from steam chamber 33 at a far greater flow rate than steam is taken from steam chamber 33 by the first steam tube 34 coupled to the positive-pressure zone Zp.

Since steam chamber 33 has a limited capacity, a valve V is interposed in auxiliary steam tube 50. This valve is adjustable to restrict the flow of steam to prevent exhaustion of steam chamber 33.

To increase the temperature of the air in the air stream flowing through the duct, one adjusts the power applied to the electric air heater element 21 so that the temperature is at the desired level. And to increase the amount of steam being generated, one increases the amount of power applied to water heater unit 28 in the steam generator so that for a given air temperature, the relative humidity is at the desired level.

When module HM operates in conjunction with a proofing chamber in the manner shown in FIG. 1, the air temperature then need to be no higher than 130° F., and to then obtain a high relative humidity, it is only then necessary to operate the module with the first steam tube 34. In operating in a proofing mode, valve V is then closed, for when open, it then provides an amount of steam which may be excessive in the proofing mode.

In the holding mode, valve V is partially or fully opened to provide sufficient steam at the elevated temperature at which the module then operates to produce the desired percent of relative humidity.

If a module in accordance with the invention is to be used only in conjunction with a proofing chamber, there is then no need for the auxiliary steam tube 50. If the module is to be used only in conjunction with a holding chamber, then the auxiliary steam tube 50 is necessary but the first steam tube 34 is optional. In practice therefore a module that only includes auxiliary tube 50 can be used for either a proofing or a holding operation.

Figure 5:
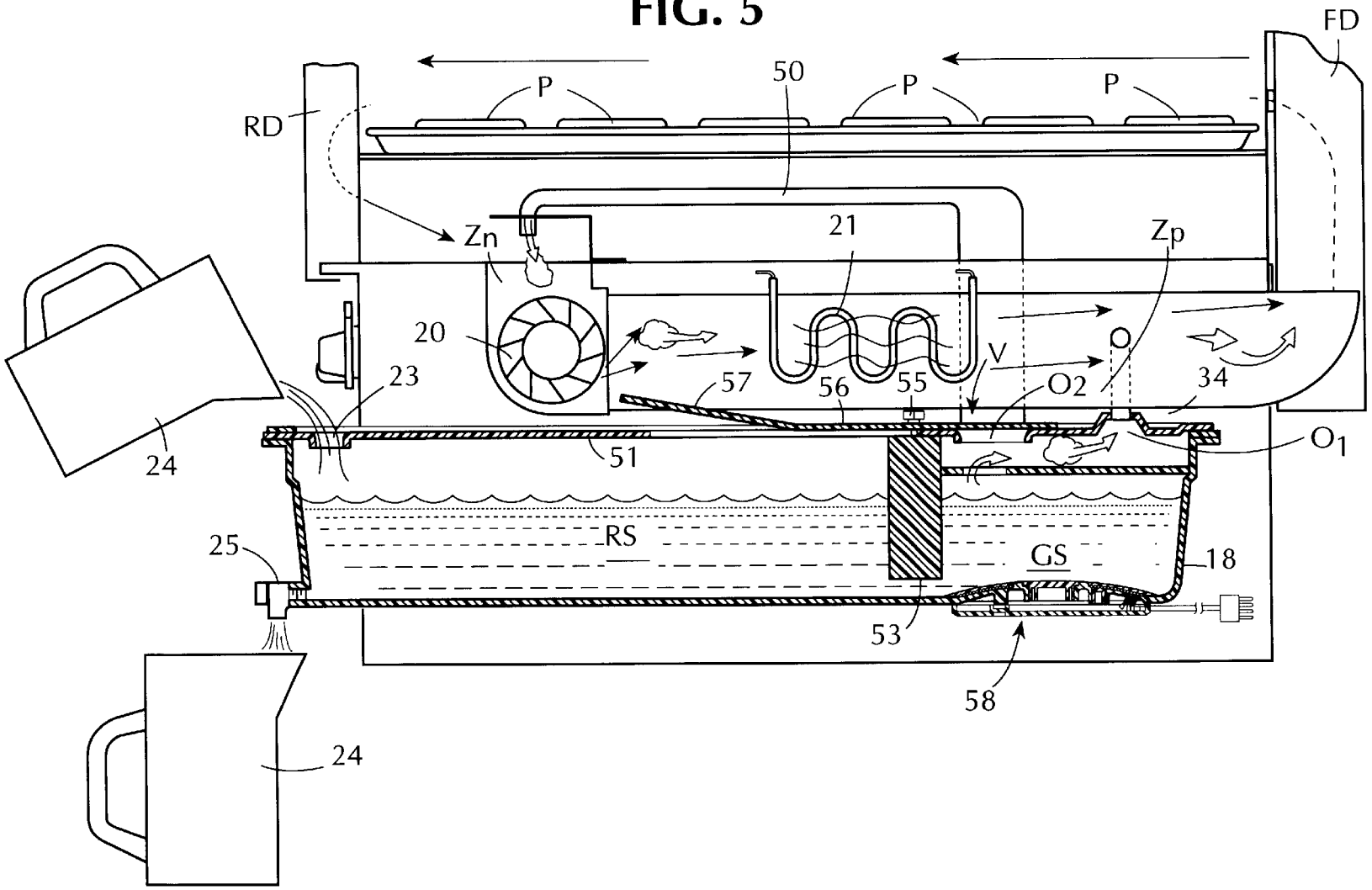
FIG. 5 shows a fourth embodiment in the form of a variable water-capacity module in which the immersion heater unit mounted in the steam generating section of the module is integrated with the plastic tank.

Instead of an auxiliary tube 50 having a valve therein to feed steam from steam generator 18 into negative-pressure zone Zn in intake 14 to the blower as shown in FIG. 5, other means may be used for this same purpose. Thus one may include in the module a duct coupling an opening in the cover of the steam generator to the intake 14, in air duct 19, the opening being provided with an adjustable shutter acting as a valve.

Variable Water Capacity Module (Third Embodiment):

In the module shown in FIGS. 1 and 3, water reservoir 17 is coupled by feed pipe 27 to the water pan 26 of steam generator 11. As a consequence, the water capacity of the reservoir and the water capacity of the separate steam generator are predetermined by their dimensions and cannot be varied.

As previously noted, the humidity and temperature conditions necessary to operate in a proofing mode differ from those required when operating in a holding mode. Thus if it becomes necessary in the holding mode to generate a large volume of steam, one needs for this purpose a steam generator having a large water capacity. But if one needs to generate steam quickly, since the steam generator is provided with a single electric heater to boil the water therein, then a smaller volume of water is required, for should the amount of water in the steam generator be large, it would take much longer for the electric heater to bring the water to its boiling point.

In the modules shown in FIGS. 1 and 3, the respective water capacities of the water reservoir and of the separate steam generator are fixed and cannot be varied. As a result, these modules lack sufficient flexibility to fully satisfy the various conditions that are encountered in operating in either a proofing or holding mode. For example, if in a holding mode, the holding chamber is heavily loaded with cooked food in a very moist condition, the atmosphere necessary in this chamber to maintain the cooked food in condition to be served in a moist condition requires a large volume of steam, far greater than is necessary in a dough proofing operation.

Figure 4:
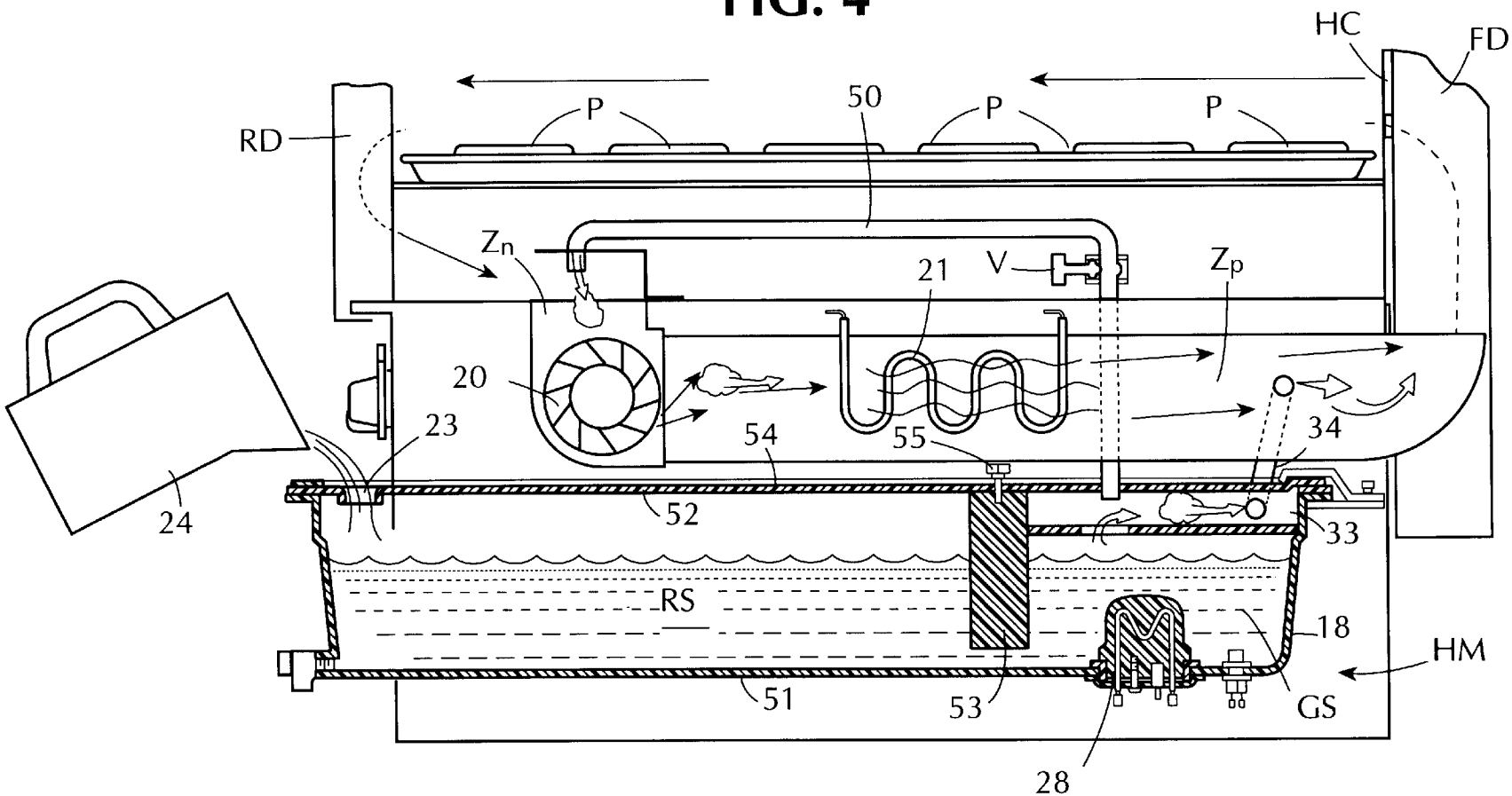
FIG. 4 shows a third embodiment in the form of a variable water-capacity module.

In order to provide a module having greater flexibility than the modules shown in FIGS. 1 and 3 which have a fixed capacity water reservoir and a separate fixed capacity steam generator, the module shown in FIG. 4 has a variable water capacity. To this end, in the module shown in FIG. 4, the water reservoir and the steam generator are integrated in a single, generally-rectangular tank 51 having a cover 52.

Tank 51 which is preferably molded of transparent, high-strength synthetic plastic material, such as polycarbonate or acrylic is divided into a reservoir section RS and a steam generator section GS by a movable barrier wall 53 having a rectangular cross section. Wall 53 depends from cover 52 to a level above the bottom tank 52 to create in the space between the lower end of the barrier wall and the bottom surface of the tank a water flow passage that couples the water reservoir section RS to the steam generator section GS. As a result of this integration, the water level is the same in both sections, and as water is boiled off in the steam generator section, the level of water declines in both sections. Water is replenished in the water reservoir section RS in the module shown in FIG. 4 in the same manner as it is replenished in the modules shown in FIGS. 1 and 3.

Barrier wall 53 is shiftable in tank 51 within limits defined by a longitudinal slot 54 formed in tank cover 52. Barrier wall 53 is secured to cover 52 by a screw clamp 55 which extends through slot 54 and turns into a threaded bore in the upper end of the wall. Thus in order to shift barrier wall 53 in either direction in the tank, screw clamp 55 is loosened to permit shifting of the wall to any desired position in the tank, and the screw clamp 55 is then tightened to maintain the set position.

When barrier wall 53 is shifted in the tank toward the left, this shift reduces the water capacity of reservoir section RS, and to the same degree it enlarges the water capacity of the steam generator section GS. A shift of the barrier wall toward the right results in a reverse reduction and increase of these water capacities. Thus by adjusting the position of barrier wall 53, one can reproportion the capacities of the respective sections of the module to attain conditions appropriate to the proofing or holding mode in which the module is to be operated.

In the proofing mode, it is usually desirable to shift barrier wall 53 to the right and thereby reduce the water capacity of steam generator section GS. This allows electric heater 28 in the steam generator section GS to more quickly boil the water in this section. A smaller quantity of water is easier to control when operating under temperature and humidity conditions appropriate for a proofing atmosphere.

For operating in a holding mode, barrier wall 53 is then shifted to the left to increase the water capacity of steam generator section GS at the expense of the water capacity of the reservoir section RS. The larger quantity of water then in the steam generator section makes it possible to attain much higher levels of humidity as is needed for the higher temperatures required in a holding mode.

There is no one ideal setting of the barrier wall for operating in the proofing or for operating in the holding mode, for it depends on the nature of the dough being proofed and on how heavily loaded is the proofing chamber or on the nature of the cooked food in the holding chamber and the extent to which this chamber is loaded. The proper setting in the holding mode depends on the atmosphere required for the particular cooked food loaded into the holding chamber.

The advantage of a variable water capacity module is that it is readily adjustable to accommodate the module to creating whatever atmosphere is dictated when operating in a proofing or holding mode.

Figure 7:
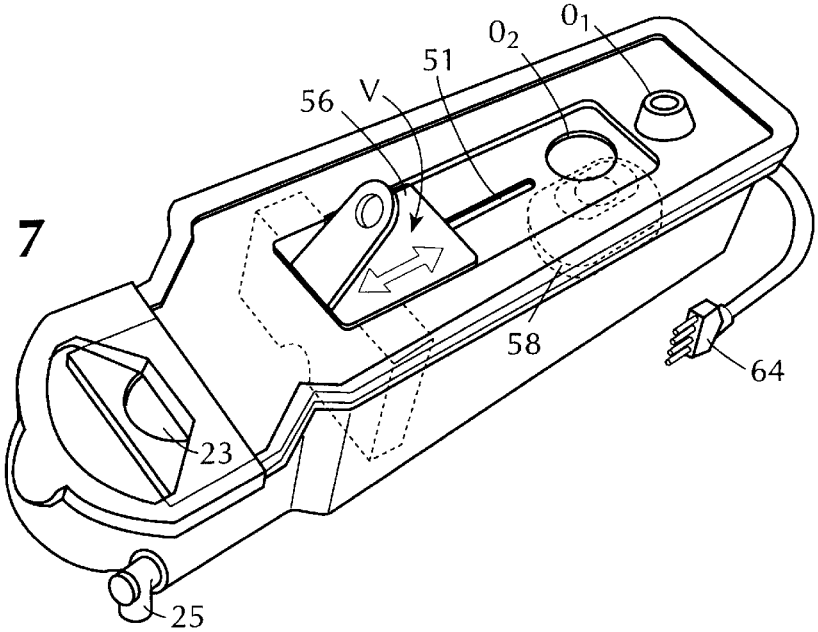
FIG. 7 is a perspective view of an actual module in accordance with the invention which is of the variable water-capacity type.

Variable Water-Capacity Module (Forth Embodiment:

FIGS. 5 illustrates schematically another version of a variable water-capacity module in accordance with the invention, FIG. 7 showing an actual commercial embodiment of this module. The module shown in FIGS. 5 and 7 has essentially the same structure as the module shown in FIG. 4, for it includes a rectangular water tank 18 molded of synthetic plastic material that is transversely divided by an adjustable barrier wall 53 into a reservoir section RS and a steam generating section RS. The relative water capacities of these sections depend on the adjusted longitudinal position of the barrier wall in the tank.

However, in FIG. 5, barrier wall 53 is attached to the underside of a shutter 56 by means of clamping screw 55. Shutter 56 is slidable on the cover of the tank over longitudinal slot 51 therein, the shutter having hinged thereto a valve extension arm 57. When the module operates in a proofing mode, valve extension arm 57 then lies flat on the cover of the tank. But when operating in a holding mode, valve arm 57 is folded up to more easily move shutter valve V and barrier 53 to the left to increase the size of the steam generating section GS.

The cover of tank 18 is provided with a steam outlet $O_1$ to which steam tube 34 is coupled to feed steam from the steam generator section GS to the positive-pressure zone $Z_p$ in the air stream duct. Also provided is an outlet $O_2$ to which steam tube 50 is coupled via shutter valve V to feed steam into the negative-pressure zone $Z_n$ in the air stream duct.

The most significant difference is that in lieu of a standard immersion electric heater, there is mounted on bottom wall 18B of the tank 18 a special immersion heater unit 58. As shown separately in FIG. 6, immersion heater 58 unit is composed of a dome-shaped upper section 59 molded of a polymer, such as a liquid crystal polymer having graphite or similar particles dispersed therein to render the polymer thermally conductive without however making it electrically conductive. Embedded within polymeric upper section 59 are the resistance wires 60 of an electrical heater element.

The polymer of the upper section 59 of the heater is merged with the polymer of the tank 18 so that there is no water leakage in the junction of the heater with the tank. For this purpose, both polymers are thermoplastic in nature. In practice, tank 18 need not be entirely transparent, for the rear section of the tank may be molded of the same non-transparent liquid crystal polymer which forms the upper section 59 of the immersion heater unit.

Mounted on a complementary molded plastic lower section 61 which is bolted or screwed to upper section 59 of the immersion heater unit 58 are a pre-heat thermostat 62 and a temperature limit sensor 63, those elements being accommodated in sockets molded in the plastic upper section. It is to be noted that the thermostat lies within the central area of the plastic upper section which is free of heater wires; hence it senses the temperature of the water in contact with the central area.

The heater element 60, the thermostat 62 and the sensor 63 are connected by wires to a cable 64 terminating in a plug 65. Plug 65 plugs into a control unit whose circuit is similar to that shown in FIG. 2. The control unit makes it possible to quickly heat up the water in the steam generating section of the module to the boiling point and to then control the rate at which the steam is generated to provide whatever degree of relative humidity is appropriate for the particular application of the module.

A major advantage of a polymer-encased immersion electric heater is that it is only the polymer that is exposed to the water, which polymer lacks affinity for lime deposits. Hence with this heater there is no need to shut down the steam generator in order to delime it. Also the electrical resistance wires of the heater element are distributed over a relatively broad polymeric surface, and make thermal contact with an equally broad water region to promote rapid heating of the water.

Humidity Control System:

When a module, as shown in FIG. 5, serves to supply steam into a chamber to humidify the atmosphere therein, it may be necessary to automatically control the relative humidity of this atmosphere so as to maintain it at a predetermined level.

This can be accomplished by an analog humidity control system that includes an analog humidity sensor, such as a Honeywell 1H 36002 unit. This sensor yields a voltage signal whose magnitude is proportional to the sensed humidity, the higher the degree of relative humidity, the greater the voltage signal.

The voltage signal from the sensor is compared in an electronic controller with a set point voltage that is adjusted to provide the desired degree of relative humidity; the controller yielding an error signal when the output voltage of the humidity sensor is less than the set point voltage. This error signal acts to control the power supplied to the heater unit of the steam generator to produce a volume of steam and a degree of relative humidity which results in a voltage signal from the sensor that matches the set point voltage, thereby nulling the error signal to maintain the relative humidity in the chamber at the desired level. When the sensor voltage is equal to or greater than the set point voltage, there is then no output from the comparator and the steam generator is not activated.

In practice, the set point voltage can be derived from an adjustable voltage divider connected across a constant voltage source.

Figure 6:
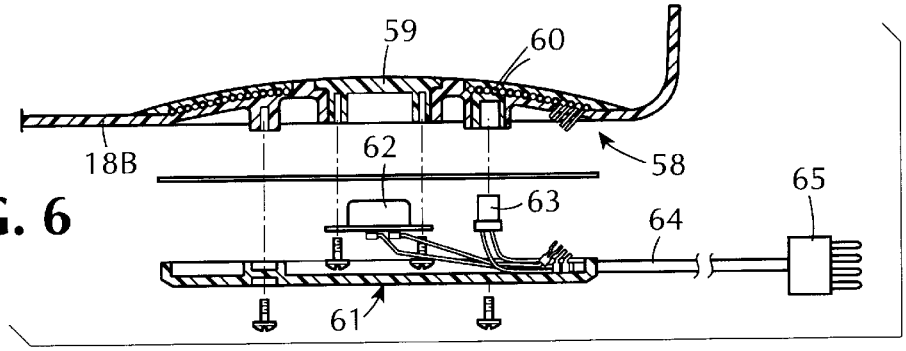
FIG. 6 is an exploded view of the immersion heater unit shown in FIG. 5.

Cast Aluminum Immersion Heater Unit:

The immersion heater unit 58 illustrated in FIGS. 5 and 6 includes a molded polymeric upper section which requires a costly mold to manufacture. Unless the unit is manufactured on a large scale, the cost per unit is then quite high.

Figure 8:
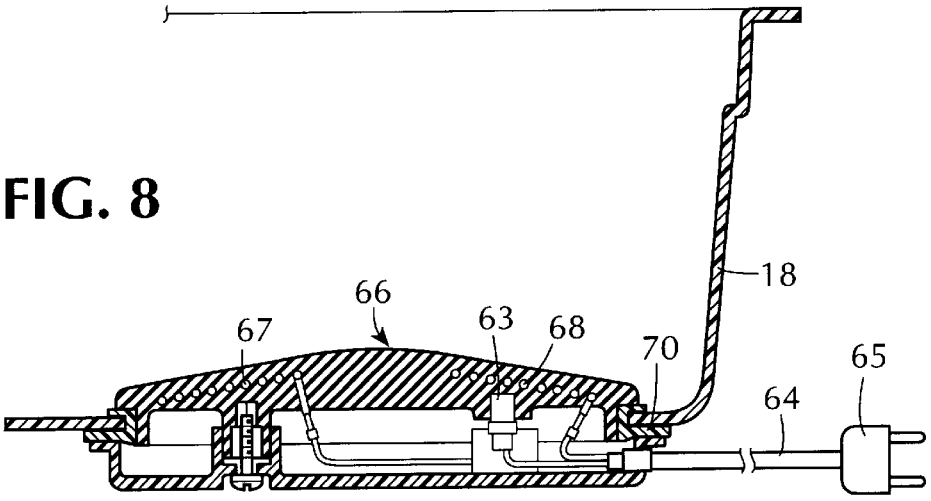
FIG. 8 shows in section another embodiment of an immersion heater unit for the module.
Figure 9:
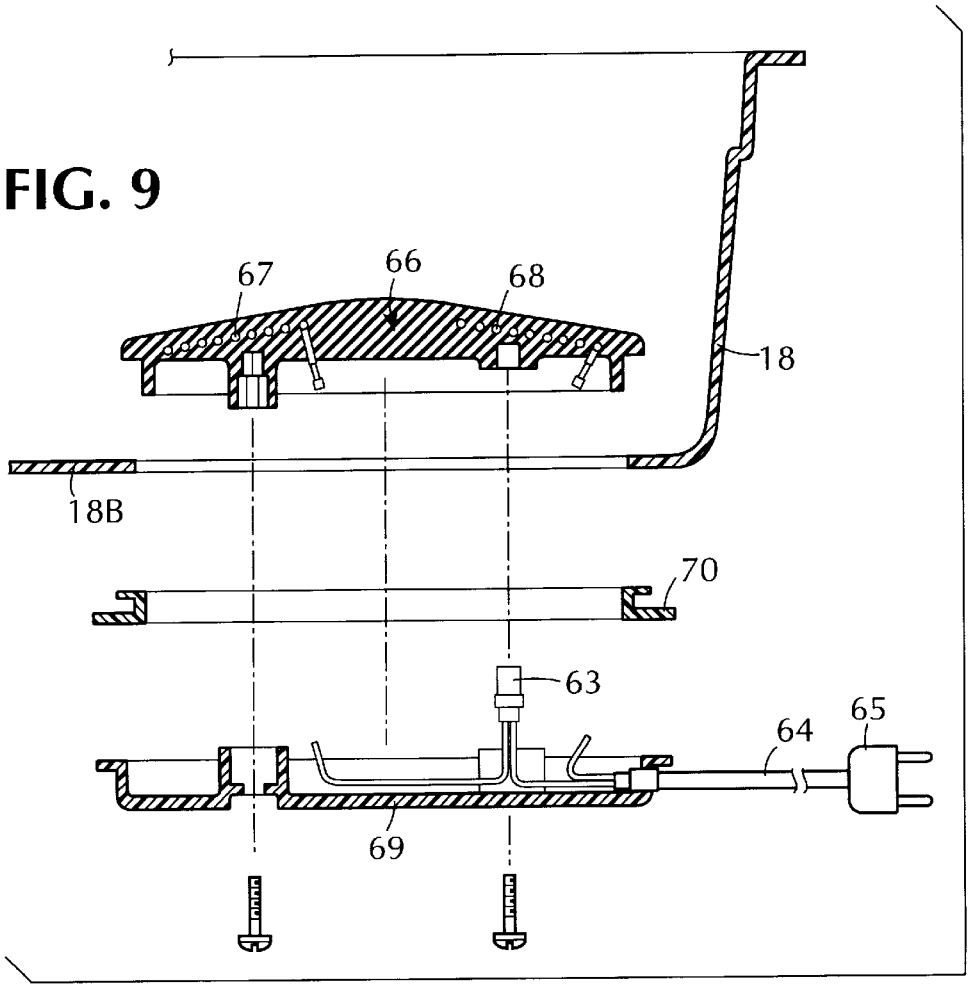
FIG. 9 is an exploded view of the unit shown in FIG. 8.

A far less expensive immersion heater unit whose configuration is similar to that of the unit in FIGS. 5 and 6 and which fits into the water tank of the module in a similar manner, is shown in FIGS. 8 and 9.

The upper section 66 of this immersion heater unit is cast of aluminum. The outer surface of the aluminum is coated with Teflon, (tetrafluoroethylene—TFE). The method of coating the aluminum is essentially the same as in coating cookware with Teflon to impart non-stick properties thereto. In the case of the immersion heater this coating prevents the deposition of lime on the surface of the unit in contact with the water, thereby doing away with the need for deliming procedures.

Embedded in the cast aluminum upper section 66 of the unit which assumes a dome-like form are electrical resistance heater elements 67 and 68. These elements are formed by a resistance wire coaxially disposed within a steel tube, the wire having a polymeric electrical insulating coating thereon that is thermally conductive. Since aluminum has a high index of thermal conductivity, heat from the electric heater elements is effectively transferred through the aluminum upper section to the water in the tank in contact therewith. The aluminum upper section 66 is molded to include a cavity to accommodate a temperature limit sensor 63, a similar sensor being included in the unit shown in FIG. 6.

A die cast lower section 69 is joined to upper section 66 by screws. Heater elements 67 and 68 and sensor 63 in the upper section are connected to cable 64 leading to plug 65 which is plugged into a power source to energize the heater unit to cause the water in the tank of the module to boil.

Sandwiched between the upper section 66 and the lower section 69 of the unit is a sealing gasket 70, preferably formed of silicone. The gasket fits into an opening formed in the bottom wall 18B of the water tank 18. When the unit is used with a sensor-based humidity controller, there is then no need for a pre-heat thermostat.

The lower section 69 is preferably molded of a high-strength polymer, such as polypropylene having a low index of thermal conductivity. Hence heat from the upper aluminum section 69 is not to any significant degree transferred through the sealing gasket and the lower section to the atmosphere and thereby wasted.

In manufacturing the unit shown in FIGS. 8 and 9, the steel tubes containing the electrical resistance wires to form heater elements 67 and 68 are bent or coiled to fit into the mold cavity for creating the aluminum upper section 66 of the unit. Molten aluminum is then injected into the mold cavity, using a standard die casting procedure for this purpose.

While there has been shown and disclosed preferred embodiments of steam generating modules in accordance with the invention, it will be appreciated that many changes and modifications may be made therein without, however, departing from the essential spirit thereof.

What is claimed is:

1. A module adapted to generate a controllable volume of steam to humidify an air stream; said module comprising:

A. a generally rectangular water-tank;

B. a barrier wall disposed transversely in said tank to divide it into a water reservoir section and a steam generating section whose relative water capacities depend on the longitudinal position of the wall within the tank;

C. an electric water heater unit disposed in the steam generating section to boil the water therein to generate steam which is discharged from this section to be fed into said air stream;

D. a flow passage in said barrier wall to cause water from the reservoir section to drain into the steam generating section as water is boiled off therefrom whereby the level of water in the steam generating section is maintained at the same level as that in the reservoir section; and E. means to shift the longitudinal position of the barrier wall to an extent and in a direction producing desired relative water capacities.

2. A module as set forth in claim 1, in which said shift means are constituted by a cover for the tank having a longitudinal slot therein through which extends a screw clamp to attach the barrier wall to the underside of the cover.

3. A module as set forth in claim 1, in which said flow passage is defined by a space between a bottom surface of a tank and the lower end of the barrier wall.

4. A module as set forth in claim 1, including electrical control means to vary the power supplied to said electric heater unit to adjust the volume of steam that is generated.

5. A module as set forth in claim 4, includes means to automatically control the power supplied to said electric heater unit to maintain the relative humidity in a chamber into which the steam is fed at a desired level.

6. A module as set forth in claim 4, in which said control means includes a pre-heat thermostat that is activated when the temperature of the water reaches a predetermined level.

7. A module as set forth in claim 1, wherein the tank is formed of transparent plastic material and a cover therefor has an inlet therein adjacent a front end of the tank, into which inlet water may be fed to replenish the water in the reservoir section; the level of water in this section being visible through the transparent tank.

8. A module as set forth in claim 7, further including an outlet in the cover for discharging steam generated in the steam generating section.

9. A module as set forth in claim 1, in which said heater unit includes a dome-shaped polymeric layer that is thermally conductive, in which layer is embedded electric resistance wires which when energized supply heat to the water in contact with said layer.

10. A module as set forth in claim 9, in which said polymeric layer has graphite particles dispersed therein to render it thermally conductive.

11. A module as set forth in claim 9, in which the polymeric layer is merged with a bottom wall of the tank formed of polymeric material.

12. A module as set forth in claim 11, further including a polymeric base layer attached to said dome-shaped layer in which is disposed a thermostatic switch in thermal contact with the water in the tank.

13. A module as set forth in claim 12, further including a temperature sensor in said base layer in thermal contact with the embedded electrical resistance wires.

14. A module as set forth in claim 1, in which said water heater unit includes an upper section of molded aluminum mounted in said water-tank, said upper section having embedded therein an electrical heater element formed by an electrical resistance wire disposed within a metal tube and electrically insulated therefrom.

15. A module as set forth in claim 14, further including an polymeric lower section joined to said upper section and a sealing gasket fitting into an opening in said water-tank and sandwiched between the upper section and the lower section.

16. A module as set forth in claim 15, in which the sealing gasket and the lower section are each formed of a material having a low degree of thermal conductivity.

17. A module as set forth in claim 14 in which the surface of the upper section in contact with water in said tank is coated with a no-stick polymeric layer.

18. A module adapted to generate a stream of hot, humid air useable in conjunction with a processing chamber to provide an atmosphere appropriate to the chamber; said module comprising:

A. an air duct having an air intake and an air outlet;

B. a motor-driven blower disposed in the duct adjacent the intake to blow a stream of air drawn through the intake toward the outlet; said blower creating in advance thereof in the duct a negative-pressure zone, and creating therebeyond a positive-pressure zone;

C. an electric air heater in the duct to heat the stream of air; and

D. means including a steam generator to feed steam into at least one of the zones to intermingle with the heated air stream whereby yielded from the outlet to provide said atmosphere is a stream of hot, humid air, said steam generator including:

a. a generally rectangular water-tank;

b. a barrier wall disposed transversely in said tank to divide it into a water reservoir section and a steam generating section whose relative water capacities depend on the longitudinal position of the wall within the tank;

c. an electric water heater unit disposed in the steam generating section to boil the water therein to generate steam which is discharged from this section to be fed into said air stream; and d. a flow passage in said barrier wall to cause water from the reservoir section to drain into the steam generating section as water is boiled off therefrom whereby the level of water in the steam generating section is maintained at the same level as that in the reservoir section.

* * * * *